US005504292A

United States Patent [19]

Bennett et al.

[11] Patent Number: 5,504,292

[45] Date of Patent: Apr. 2, 1996

[54] ARC STACK FOR A CIRCUIT BREAKER

[75] Inventors: Dale W. Bennett, Cedar Rapids, Iowa; James V. Fixemer, Denton, Nebr.; Teresa I. Hood, Coralville, Iowa; Joel L. Miller; Charles E. Netolicky, both of Cedar Rapids, Iowa; Tamara L. Schultz, Marion, Iowa; Randall L. Siebels, Cedar Rapids, Iowa; Douglas Van Waart, Anamosa, Iowa

[73] Assignee: Square D Company, Palatine, Ill.

[21] Appl. No.: 195,233

[22] Filed: Feb. 14, 1994

Related U.S. Application Data

[63] Continuation-in-part of Ser. No. 181,288, Jan. 13, 1994.

[51] Int. Cl.[6] ..... H01H 33/08

[52] U.S. Cl. ..... 218/81; 218/15; 218/34

[58] Field of Search ..... 200/144 R, 146 R, 200/147 R, 148 B, 145 R, 148 C, 144 C; 218/1, 2, 8, 15, 22, 34, 35, 36, 37, 38, 39, 43, 46, 47, 81, 103, 155, 156

[56] References Cited

U.S. PATENT DOCUMENTS

| | | | |
|---|---|---|---|
| 2,652,469 | 9/1953 | Weston | 200/144 |
| 2,671,146 | 3/1954 | Driver | 200/148 |
| 3,943,316 | 3/1976 | Oster | 200/337 |
| 3,943,472 | 3/1976 | Oster et al. | 335/16 |
| 3,944,953 | 3/1976 | Oster | 335/23 |
| 3,946,346 | 3/1976 | Oster et al. | 335/16 |
| 4,417,223 | 11/1983 | Bancalari | 335/195 |
| 4,740,768 | 4/1988 | Morris et al. | 335/22 |
| 4,876,421 | 10/1989 | Miller et al. | 200/144 C |
| 5,003,137 | 3/1991 | Tateishi et al. | 200/144 R |
| 5,003,139 | 3/1991 | Edds et al. | 200/401 |
| 5,073,764 | 12/1991 | Takahashi et al. | 335/16 |
| 5,075,657 | 12/1991 | Rezac et al. | 335/6 |
| 5,097,589 | 3/1992 | Rezac et al. | 29/622 |
| 5,159,304 | 10/1992 | Yamagata et al. | 335/202 |
| 5,245,302 | 9/1993 | Brune et al. | 335/35 |

FOREIGN PATENT DOCUMENTS

| | | | |
|---|---|---|---|
| 1573589 | 7/1969 | France | H01H 9/34 |
| 2269191 | 11/1975 | France | H01H 73/18 |
| 1020396 | 5/1958 | Germany . | |
| 615025 | 12/1948 | United Kingdom | H01H 9/34 |

*Primary Examiner*—Kristine L. Kincaid
*Assistant Examiner*—Michael A. Friedhofer
*Attorney, Agent, or Firm*—Larry I. Golden; Kareem M. Irfan

[57] ABSTRACT

An arc stack for receiving a circuit breaker blade moveable between a closed position and an open position, includes a plurality of arc plates positioned substantially parallel to one another and arranged in a plurality of adjacent groups. Each of the groups includes one or more arc plates having substantially similar respective arc throats formed therein. The respective arc throats progressively decrease in size from group to group along the length of the arc stack in a direction extending away from the closed position of the blade. A connecting support maintains the plurality of arc plates substantially parallel to one another.

10 Claims, 9 Drawing Sheets

PRIOR ART

ARC STACK FOR A CIRCUIT BREAKER

REFERENCE TO RELATED APPLICATION

This application is a continuation-in-part of copending U.S. patent application Ser. No. 08/181,288, filed Jan. 13, 1994, and entitled "Arc Stack for a Circuit Breaker".

FIELD OF THE INVENTION

The present invention relates generally to circuit breakers and, more particularly, to an arc stack for a circuit breaker.

BACKGROUND OF THE INVENTION

Arc stacks suppress the electrical arc created between a stationary contact and the movable contact of a circuit breaker blade as the blade moves from a closed position to an open position during a fault condition. One type of arc stack, designated in FIG. 1 as reference numeral 100, includes a plurality of identical, generally rectangular plates positioned and interconnected parallel to one another. The plates have respective identically-shaped arc throats to form a passageway for the moveable blade. To maximize performance of the arc stack, the passageway formed by interconnecting the plates with the respective individual arc throats follows the radius of the moveable blade as it opens. This is accomplished by laterally offsetting the identical arc plates relative to one another in the same direction so that the individual arc throats follow the radius of the moveable blade. Thus, the arc stack takes on an elongated curved shape.

A drawback of this type of arc stack is that it is difficult to manufacture with automated equipment because its construction requires complex manipulation of the circuit breaker components surrounding the arc stack.

Another drawback of this type of arc stack is that it takes up a significant amount of space within the circuit breaker enclosure. Referring to the arc stack of FIG. 1, for example, due to the irregular shape of the arc stack, it occupies an unnecessarily large volume within the enclosure.

In addition to overcoming the foregoing drawbacks, it is desirable to construct an arc stack which dissipates the electrical arc in a more efficient manner, thereby resulting in reduced pressures, higher exit voltages, lower let-through currents, and improved circuit breaker interruption.

Moreover, there is an ongoing effort to reduce the cost and size of circuit breakers while reducing the labor required to assemble and maintain the circuit breakers.

SUMMARY OF THE INVENTION

The present invention provides an arc stack which can be assembled in a relatively compact area within a circuit breaker enclosure.

The present invention also provides an arc stack which is easily manufactured using automated equipment.

The present invention further provides an arc stack which promotes efficient dissipation of an electrical arc generated between the stationary and movable contacts of a circuit breaker during a fault condition.

The present invention also provides an arc stack construction which is cost-effective and easy to manufacture.

In one particular embodiment, the foregoing objects are realized by providing an arc stack for receiving a circuit breaker blade moveable between a closed position and an open position. The arc stack includes plurality of arc plates positioned substantially parallel to one another and arranged in a plurality of adjacent groups. Each of the groups includes one or more arc plates having substantially similar respective arc throats formed therein. The respective arc throats progressively decrease in size from group to group along the length of the arc stack in a direction extending away from the closed position of the blade. A connecting support maintains the plurality of arc plates substantially parallel to one another.

The above summary of the present invention is not intended to represent each embodiment, or every aspect, of the present invention. This is the purpose of the figures and the detailed description which follow.

BRIEF DESCRIPTION OF THE DRAWINGS

Other objects and advantages of the invention will become apparent upon reading the following detailed description and upon reference to the drawings in which.

Figure 1:
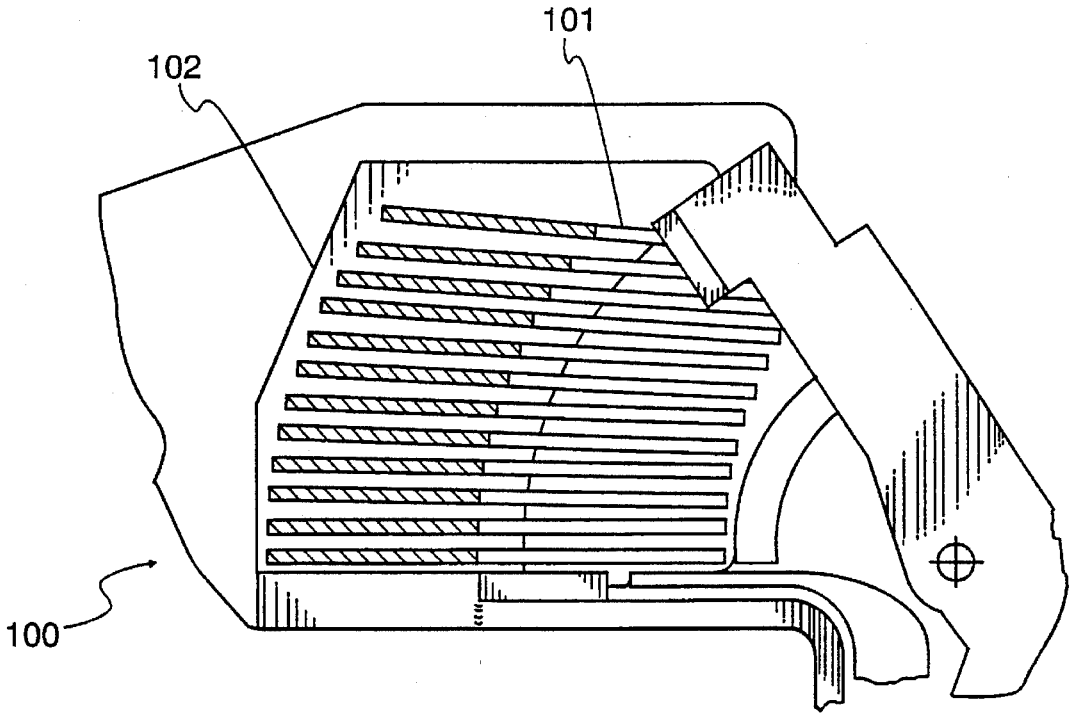
FIG. 1 is a side view of one type of prior art arc stack.

While the invention is susceptible to various modifications and alternative forms, specific embodiments thereof have been shown by way of example in the drawings and will be described in detail. It should be understood, however, that it is not intended to limit the invention to the particular form described. On the contrary, the intention is to cover all modifications, equivalents, and alternatives falling within the spirit and scope of the invention as defined by the appended claims.

DETAILED DESCRIPTION OF THE PREFERRED EMBODIMENT

Turning now to the drawings, the present invention is discussed in the context of an exemplary double-break circuit breaker using an arc stack embodying the principles of the present invention. The particular circuit breaker illustrated and described (FIG. 2) should not, however, be construed to limit the possible applications for the present invention, as these applications encompass a wide variety of circuit breaker types. To fully appreciate the utility of the present invention, however, the double-break circuit breaker of FIG. 2 will first be described, followed by a detailed description of a secondary arc stack 10 generally depicted in the circuit breaker of FIG. 2. An alternative embodiment for the secondary arc stack is also disclosed.

Figure 2:
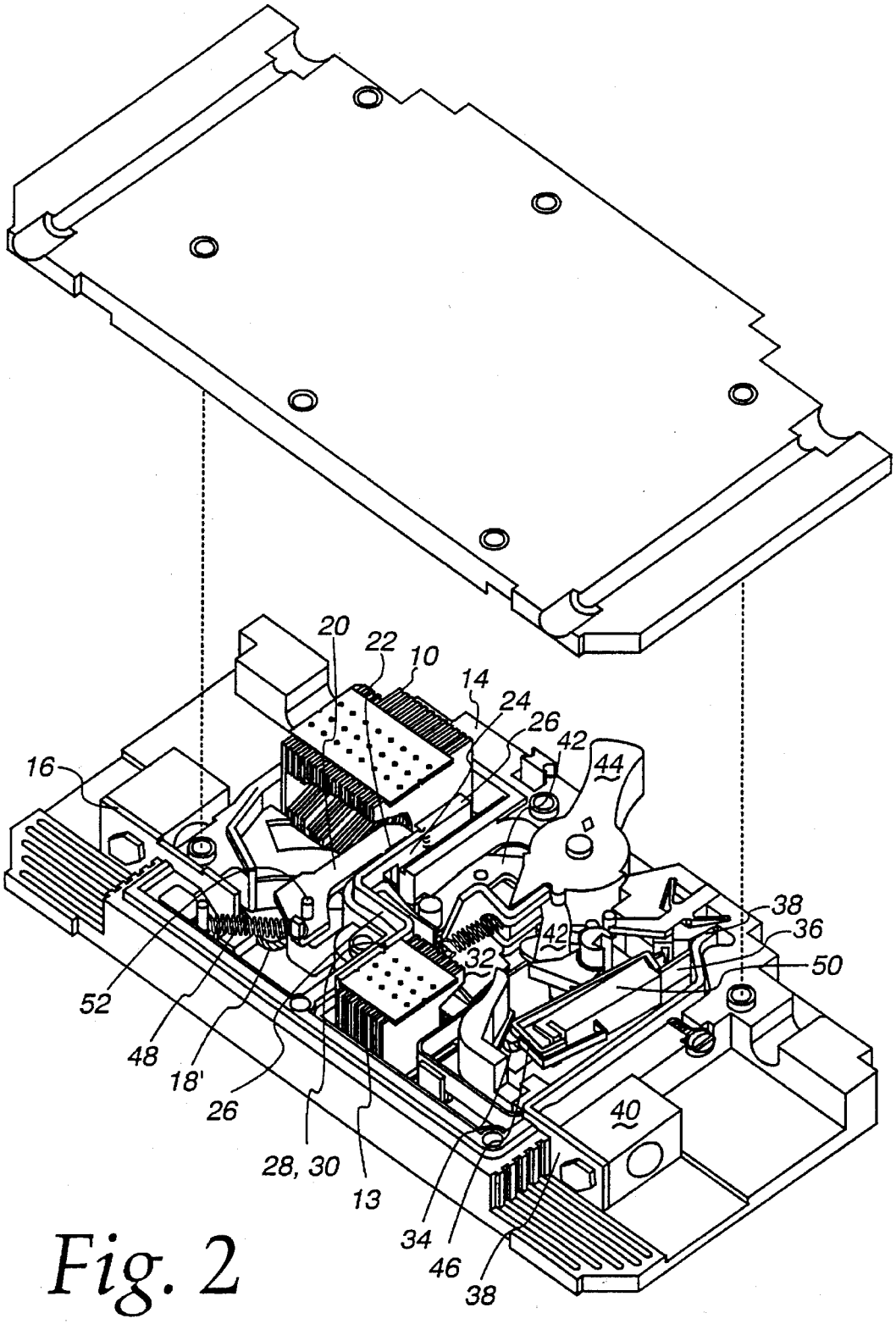
FIG. 2 is a side view of a double-break circuit breaker including an arc stack embodying the present invention.

The circuit breaker of FIG. 2 includes a circuit breaker base 14 which carries all of the internal components of the circuit breaker. The current path through the circuit breaker begins at a line terminal 16, and from the line terminal 16 the current path goes through a flexible pigtail 18. The flexible pigtail 18 is attached to a secondary blade 20 with a moveable contact 22 mating with a stationary contact 24. Current flows through the moveable and stationary contacts 22, 24 to the mid terminal 26, which is configured in an S form. The other side of the mid terminal 26 includes another stationary contact 28 connected thereto. Positioned opposite the stationary contact 28 is a mating moveable contact 30 attached to a primary blade 32. Current flows through the stationary and moveable contacts 28, 30, through the primary blade 32, and into one end of a primary flexible connector or pigtail 34. The other end of the primary flexible connector 34 is attached to a bimetal 36, which provides the thermal tripping characteristics for the circuit breaker. Finally, the current flows from the bimetal 36 through a load terminal 38 and out of the load end of the circuit breaker via a lug 40.

The primary section of the circuit breaker includes the primary blade 32, a trip lever 42, a handle 44, a magnetic armature 46, a pigtail 34, and a primary arc stack 13. The secondary section includes the secondary blade 20, the pigtail 18, an extension spring 48, and the secondary arc stack 10. In the illustrated circuit breaker, using conventional magnetic and thermal trip protection features, the primary section provides the breaking capacity for all levels of current from one ampere to approximately 3000 amperes without operational assistance from the secondary section. The magnetic armature 46 is drawn to a yoke 50 during high current flow. This allows the trip lever 42 to disengage from the magnetic armature 46 and rotate to the trip position, which, in turn, allows the primary blade contact 30 to separate from the stationary contact 28 to break the current flow. As the contacts 28, 30 are separated, an arc voltage is generated in the primary arc stack 13. A thermal trip via the bimetal 36 results in the same sequence of events and, additionally, results in the trip lever 42 disengaging from the magnetic armature 46.

The normal ON and OFF operation of the primary blade 32 occurs in response to rotation of the handle 44 in a clockwise or counterclockwise motion. In response to rotation of the handle 44 in either direction, the primary blade 32 either opens or closes the circuit via the primary moveable contact 30 and the primary stationary contact 28. Rotation of the primary blade 32 is tied directly to the handle 44 for the normal ON and OFF operation of the primary blade 32. Furthermore, the secondary section is not affected by the normal ON and OFF operation of the primary blade 32. The secondary blade contact 22 and the secondary stationary contact 24 remain closed.

As previously explained, the secondary section of the circuit breaker has limited operation below 3000 amperes of fault current. However, at current levels above 3000 amperes, the secondary section begins to contribute to interruption performance. In particular, the secondary blade 20 derives contact force from the extension spring 8. The secondary blade 20 pivots about the blade pivot 52 with the extension spring 48 extended as the secondary blade 20 opens up in response to a current fault above 3000 amperes. There is no linkage of the secondary blade 20 to the primary blade 32, but rather the operation of the secondary and primary blades 20, 32 is totally separate and independent.

In response to the occurrence of a current fault above 3000 amperes, the constriction resistance of the secondary blade contact 22 and the secondary stationary contact 24 provides a magnetic force that tries to separate the contacts. Simultaneously, the current path configuration of the mid terminal 26 and the secondary blade 20 forms a magnetic blowoff loop which also tries to separate the contacts 22, 24. The addition of both of these opening forces to the secondary blade 20 causes the secondary blade 20 to separate at the contacts 22, 24. As the secondary blade 20 opens, the extension spring 48 begins to stretch. The extension spring 48 permits the secondary blade 20 to continue to open as long as the force to open the blade is greater than the extension force of the spring 48. As the contacts 22, 24 are separated, an arc voltage is generated in the secondary arc stack 10. The combination of the arc voltage generated by the secondary arc stack 10 and the arc voltage generated by the primary arc stack 13 make these voltages add together. This allows a very fast rise of arc voltage and also allows high levels of arc voltage consistent with double-break circuit breakers.

As the current fault level rises significantly above 3000 amperes, the faster and higher the secondary blade 20 will be moved. As the interruption takes place and the electrical arc is extinguished in the primary and secondary sections, the secondary blade 20 is biased to return to the closed position because of the bias from the extension spring 48. The primary blade remains in the open or tripped position. At this point, the interruption of the current fault is complete with no opportunity to re-establish itself.

For further information regarding the overall construction and operation of the circuit breaker shown in FIG. 2, reference may be made to U.S. patent application Ser. No. 08/181,289, entitled "Circuit Breaker Having Double Break Mechanism", filed Jan. 13 1994, assigned to the instant assignee and incorporated herein by reference.

Figure 3:
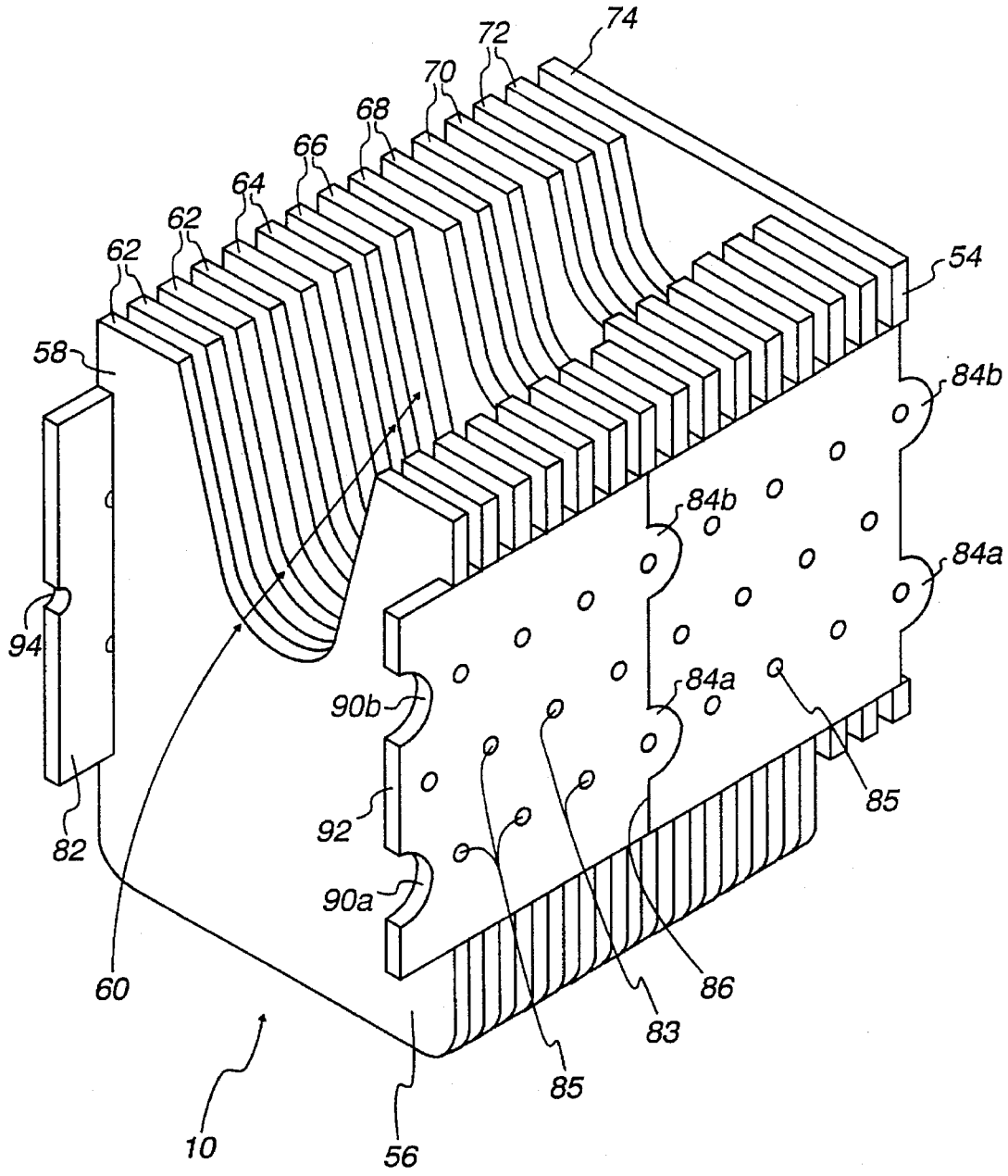
FIG. 3 is a perspective view of the arc stack of FIG. 2, according to the present invention.
Figure 4:
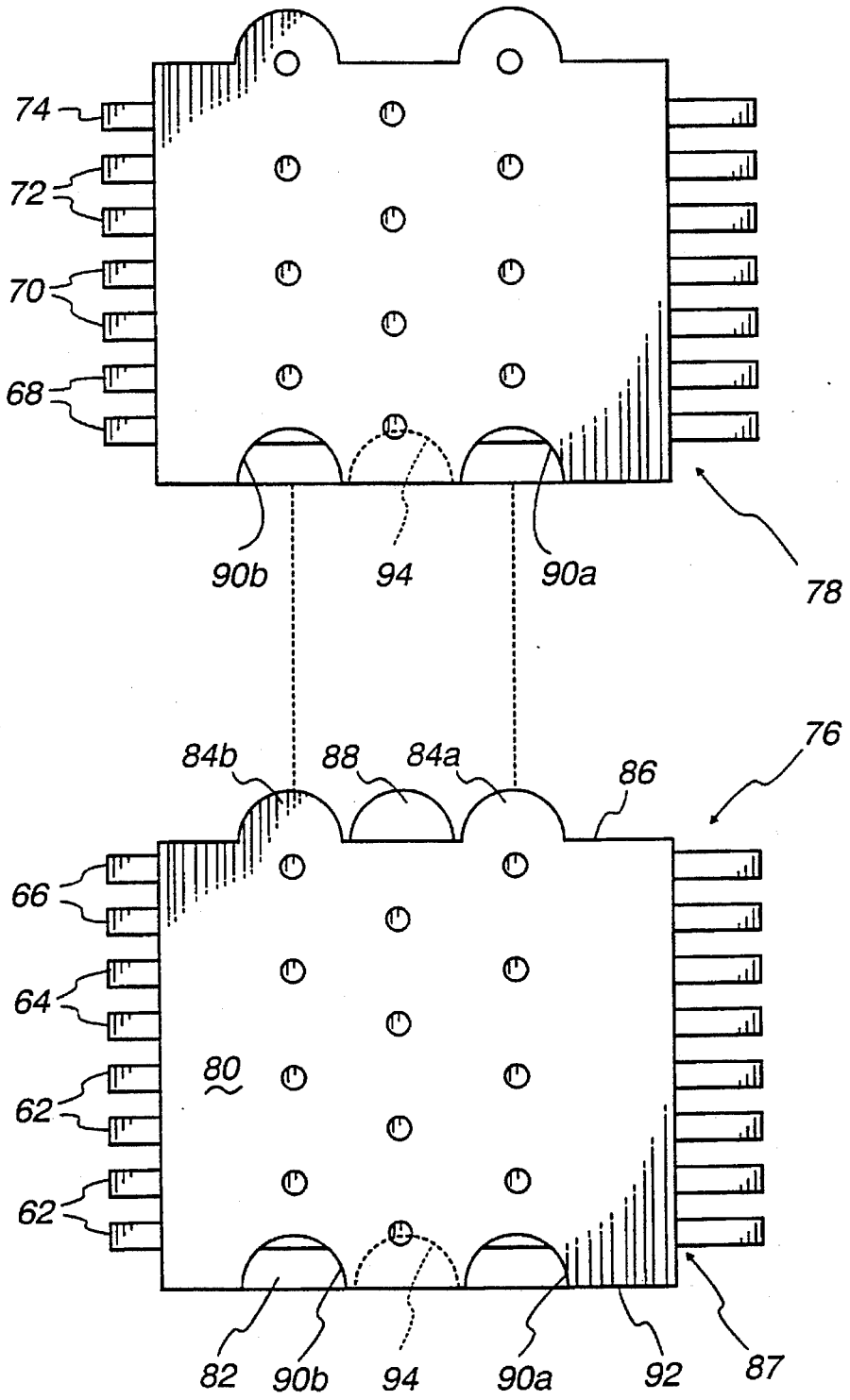
FIG. 4 is a side view of two assemblies which can be combined to form the arc stack in FIG. 3.

FIGS. 3 and 4 illustrate the secondary arc stack 10 which is used in the exemplary circuit breaker of FIG. 1. The secondary arc stack 10 is z-axis assembled into the base 14 of the circuit breaker in FIG. 2. More specifically, the secondary arc stack 10 is placed into the base 14 with the bottom surface 54 abutting the bottom of the base 14 and the side 56 positioned adjacent and substantially parallel to one end of the mid terminal 26. In the assembled form of the circuit breaker, the secondary blade 20 extends into the arc stack side 58 having a longitudinal passageway 60 formed therein.

The secondary arc stack 10 is generally rectangular in shape and is formed by interconnecting a series of individual arc plates 62, 64, 66, 68, 70, 72, and 74. Except for the end arc plate 74, the individual arc plates have respective individual arc throats formed therein by means such as metal stamping. The longitudinal passageway 60 created by the individual arc throats follows the arc that the secondary blade 20 generates about the blade pivot 52. The four arc plates closest to the mid terminal 26 are identical and are labelled by the reference numeral 62. Adjacent to the four arc plates 62 are two identical arc plates 64 having an arc throat shorter than the arc throat of the arc plates 62. Similarly, the arc throat of the two identical arc plates 66 is shorter than the arc throat of the two identical arc plates 64, the arc throat of the two identical arc plates 68 is shorter than that of the two arc plates 66, the arc throat of the two identical arc plates 70 is shorter than that of the two arc plates 68, the arc throat of the two identical arc plates 72 is shorter than that of the two arc plates 70, and the end arc plate 74 has no arc throat. The foregoing progression of different plate profiles follows the arc of the secondary blade 20 about the blade pivot 52.

An advantage of forming the secondary arc stack 10 from arc plates having a progression of arc throat profiles matching the arcing radius of the secondary blade 20 is that the arc stack 10 is compact, taking up a minimal amount of space. Furthermore, this progression of arc throat profiles permits the secondary arc stack 10 to be easily manufactured with automated equipment and to promote enhanced interruption performance. Manufacturing the secondary arc stack 10 with automated equipment, in turn, lowers the cost of manufacturing the secondary arc stack 10.

Referring to FIGS. 3 and 4, the secondary arc stack 10 is assembled from a lower section 76 and an upper section 78. The lower section 76 of the secondary arc stack 10 includes eight arc plates 62, 64, and 66 held together by top and bottom side fibers 80, 82 (FIG. 3). The side fibers 80, 82 include positioning holes 83 which receive respective protrusions 85 extending from the respective upper and lower edges of the arc plates 62, 64, and 66. Furthermore, the side fibers 80, 82 are positioned within respective rectangular slots 87 extending from the outermost arc plate 62 to the innermost arc plate 66 and formed from individual slots in the respective upper and lower edges of all the arc plates 62, 64, and 66. The rectangular slots 87 and the mating holes 83 and protrusions 85 promote a firm engagement between the side fibers 80, 82 and the arc plates 62, 64, and 66, and retain the arc plates together as an assembly.

The top side fiber 80 has a different profile than the bottom side fiber 82. In particular, the top side fiber 80 has two male nubs 84*a* and 84*b* protruding from the connecting edge 86, while the bottom side 82 only has one male nub 88 protruding from its connecting edge (FIG. 4). Also, the top side fiber 80 has two female nubs 90*a* and 90*b* formed in the outer edge 92, while the bottom side 82 only has one female nub 94 formed in its outer edge.

The upper section 78 of the secondary arc stack 10 has top and bottom side fibers 96, 98 with edge profiles identical to the edge profiles of the respective top and bottom side fibers 80, 82 of the lower section 76. Therefore, like parts are indicated by the same reference numerals. One difference between the lower section 76 and the upper section 78 of the arc stack 10 is that the lower section 76 includes one more arc plate than the upper section 78. The upper section 78 only includes the seven arc plates 68, 70, 72, and 74. Another difference, as previously stated, is that the seven arc plates 68, 70, 72, and 74 are configured with different arc throats than the arc plates 62, 64, and 66.

To connect the lower and upper sections 76, 78 together, the corresponding nubs along the connecting edges of the top and bottom side fibers on both the lower and upper sections 76, 78 are mated together. In particular, the male nubs 84*a*, 84*b* along the connecting edge 86 of the top side fiber 80 of the lower section 76 are engaged with the respective female nubs 90*a*, 90*b* along the connecting edge of the top side fiber 96 of the upper section 78. Furthermore, the male nub 88 along the connecting edge of the bottom side fiber 82 of the lower section 76 is engaged with the corresponding female nub 94 along the connecting edge of the bottom side fiber 98 of the upper section 78. As the lower and upper sections 76, 78 are brought together, they appear as a single secondary arc stack 10 as shown in FIG. 3 with all the arc plates fitting together.

Not only is the manufacturing cost for the secondary arc stack 10 lowered because it is produced by automated equipment, but the manufacturing cost is further lowered because it is produced from multi-sections, i.e., the lower section 76 and the upper section 78, instead of from just one section. Producing the secondary arc stack 10 in multi-sections reduces the cost of all the equipment required to handle the arc stack 10 because less capacity is needed to handle the multi-sections. Moreover, the stamping tonnage require to stamp out the arc plates is dramatically reduced in a multi-section assembly in the automated equipment.

Figure 5:
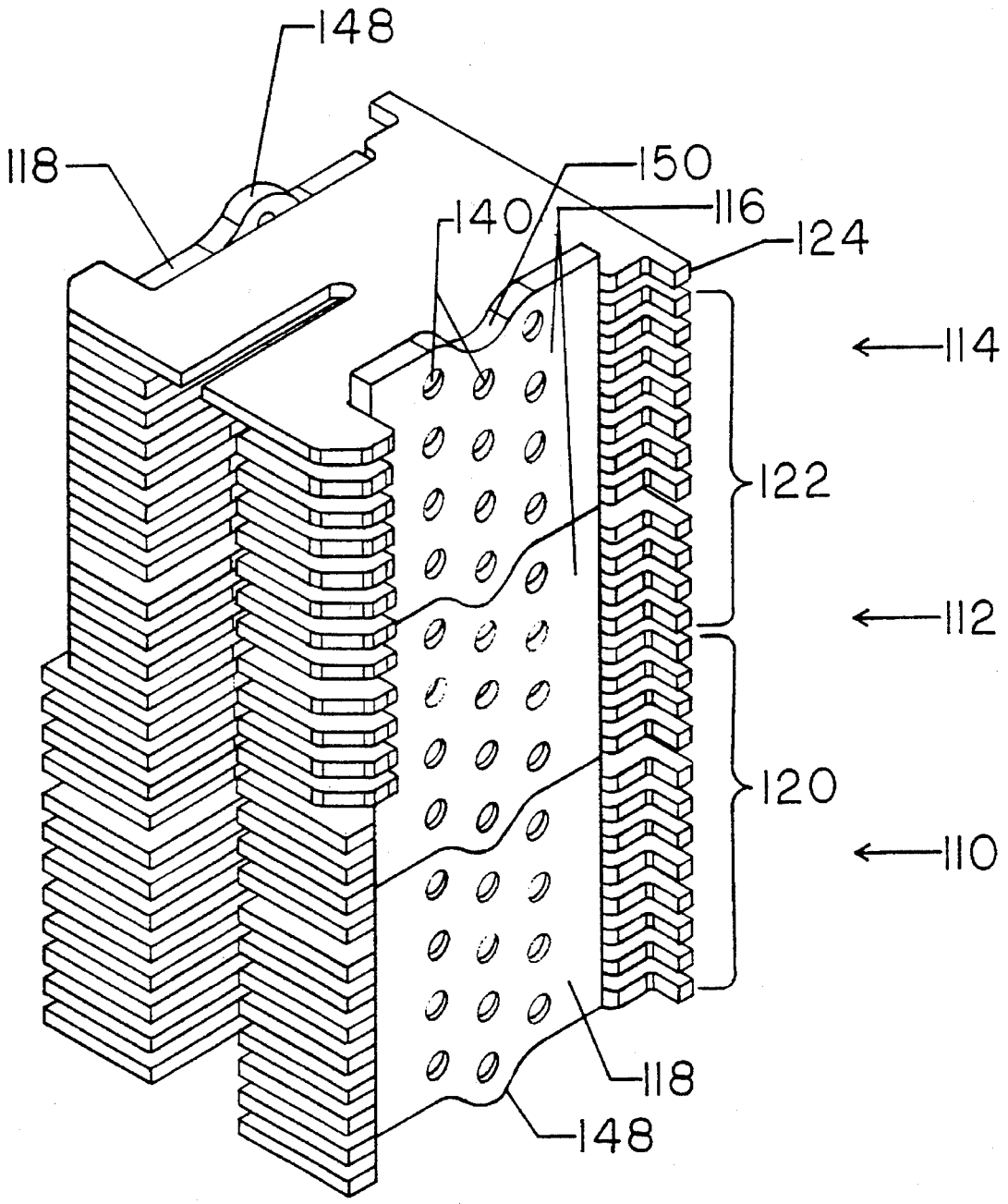
FIG. 5 is a perspective view of a modified arc stack embodying the present invention.

In an alternative embodiment, the arc stack, designated by the reference numeral 10', is constructed as illustrated in FIGS. 5–8. As shown in FIG. 5, this modified arc stack 10' is composed of three separate sections 110, 112, and 114, each of which includes eight parallel arc plates held together by top and bottom side insulating fibers 116, 118. Thus, each of the three sections 110, 112, and 114 is associated with one of the three top side fibers 116 and one of the three bottom side fibers 118. Each of the plates of the arc stack 10' have the same thickness, and the plates are spaced equidistant from each other. This distance between adjacent plates is substantially equal to the thickness of an arc plate.

Figure 6:
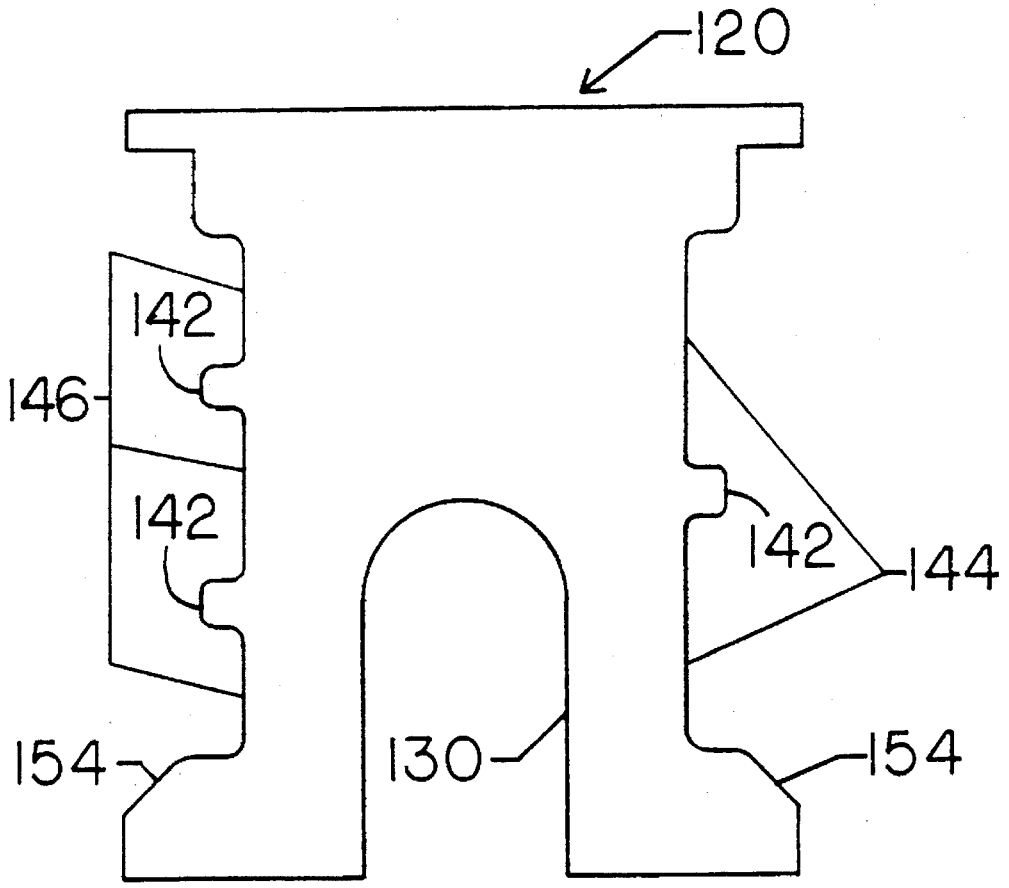
FIG. 6 is a plan view of an arc plate used in the arc stack of FIG. 5.
Figure 7:
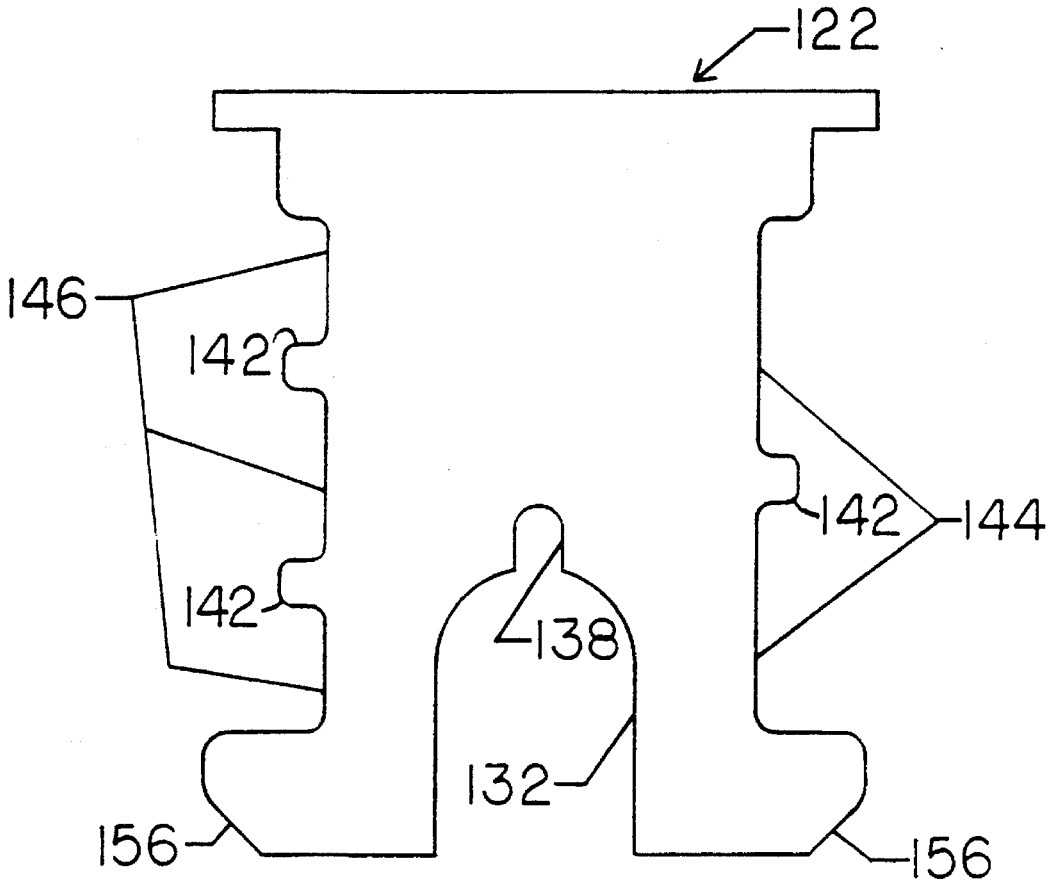
FIG. 7 is a plan view of an arc plate used in the arc stack of FIG. 5.
Figure 8:
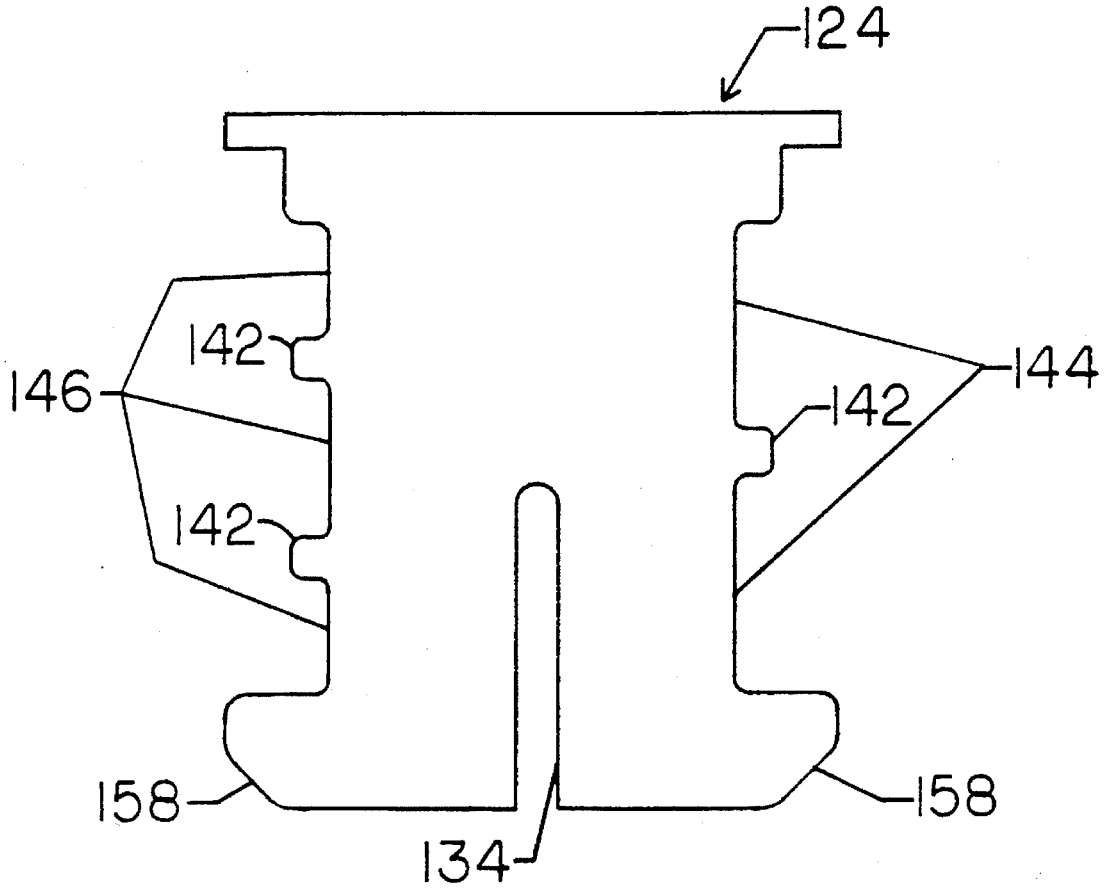
FIG. 8 is a plan view of an arc plate used in the arc stack of FIG. 5.

The section 110 of the arc stack 10' includes eight identical arc plates 120 configured as shown in FIG. 6. Similarly, the section 112 includes four arc plates 120 identical to those arc plates 120 in the section 110 and four identical arc plates 122 (FIG. 7). The section 114 includes seven arc plates 122 identical to the top four arc plates 122 in the section 112 and an arc plate 124 (FIG. 8). It can be seen from FIGS. 6–8 that the primary difference between the arc plates 120, 122, and 124 is the size and configuration of their respective arc throats. The arc throat 130 of the arc plate 120 is larger than the arc throat 132 of the arc plate 122, which, in turn, is larger than the arc throat 134 of the arc plate 124.

While the arc throats 130, 132, and 134 have substantially the same depth, these arc throats have different widths relative to one another over their depths. In particular, the arc throat 130 of the arc plate 120 has approximately the same width over its entire depth and is formed by a pair of parallel linear sides bridged by a semicircular end. The arc throat 132 of the arc plate 122 has the same width as the arc throat 130 over a portion thereof, but then the arc throat 132 narrows to form a notch 138 extending into the arc plate 122 from its semicircular end. Finally, the arc throat 134 of the arc plate 124 is much narrower than the arc throats 130, 132, for the arc throat 134 has approximately the same width as the notch 138 in the arc throat 132. Moreover, the arc throat 134 preferably has approximately the same length as the arc throats 130, 132.

To connect the top and bottom side fibers 116, 118 to the arc plates 120, 122, and 124, the side fibers 116, 118 include positioning holes 140 (FIG. 5) which receive respective tabs 142 (FIGS. 6–9) extending from the upper and lower edges of the arc plates 120, 122, and 124. There are three rows of positioning holes 140 is each of the side fibers 116, 118. The upper edge of each of the arc plates includes a single tab 142 constructed and arranged to engage with a respective hole 140 in the second (middle) row of the positioning holes 140. The lower edge of each of the arc plates includes a pair of tabs 142 constructed and arranged to engage with respective holes 140 in the first and third rows of the positioning holes 140. Furthermore, the side fibers 116, 118 extend through rectangular slots 144, 146 formed in the respective upper and lower edges of all the arc plates 120, 122, and 124 (FIGS. 6–8). The rectangular slots 144, 146 and the mating holes 140 and tabs 142 promote a firm engagement between the side fibers 116, 118 and the arc plates, and retain the arc plates together as an assembly.

To engage the sections 110, 112, and 114 with each other to form the multi-piece arc stack 10', each of the top and bottom side fibers 116, 118 is provided with a male nub 148 along one edge and a female nub 150 along an opposite parallel edge (FIG. 5). More specifically, the female nub 150 along the upper edge of the top side fiber 116 of the section 110 engages with the male hub 148 along the lower edge of the top side fiber 116 of the section 112. Similarly, the female nub 150 along the upper edge of the top side fiber 116 of the section 112 engages with the male nub 148 along the lower edge of the top side fiber 116 of the section 114.

The bottom side fibers 118 are engaged to one another in a similar fashion. Although hidden from view in FIG. 5, it should be apparent that the male nub 148 along the upper edge of the bottom side fiber 118 of the section 110 engages with the female nub 150 along the lower edge of the bottom side fiber 118 of the section 112. Similarly, the male nub 148 along the upper edge of the bottom side fiber 118 of the section 112 engages with the female nub 150 along the lower edge of the bottom side fiber 118 of the section 114.

The arc stack 10' in FIG. 5 is constructed from the three sections 110, 112, and 114. Since each section has a maximum arc voltage which it can dissipate, the voltage performance of the arc stack 10' is increased with each addition of a section to the arc stack 10'. Furthermore, by building the arc stack 10' in sections, fewer than three sections could be used for lower voltage ratings, thereby reducing parts and cost.

Figure 9:
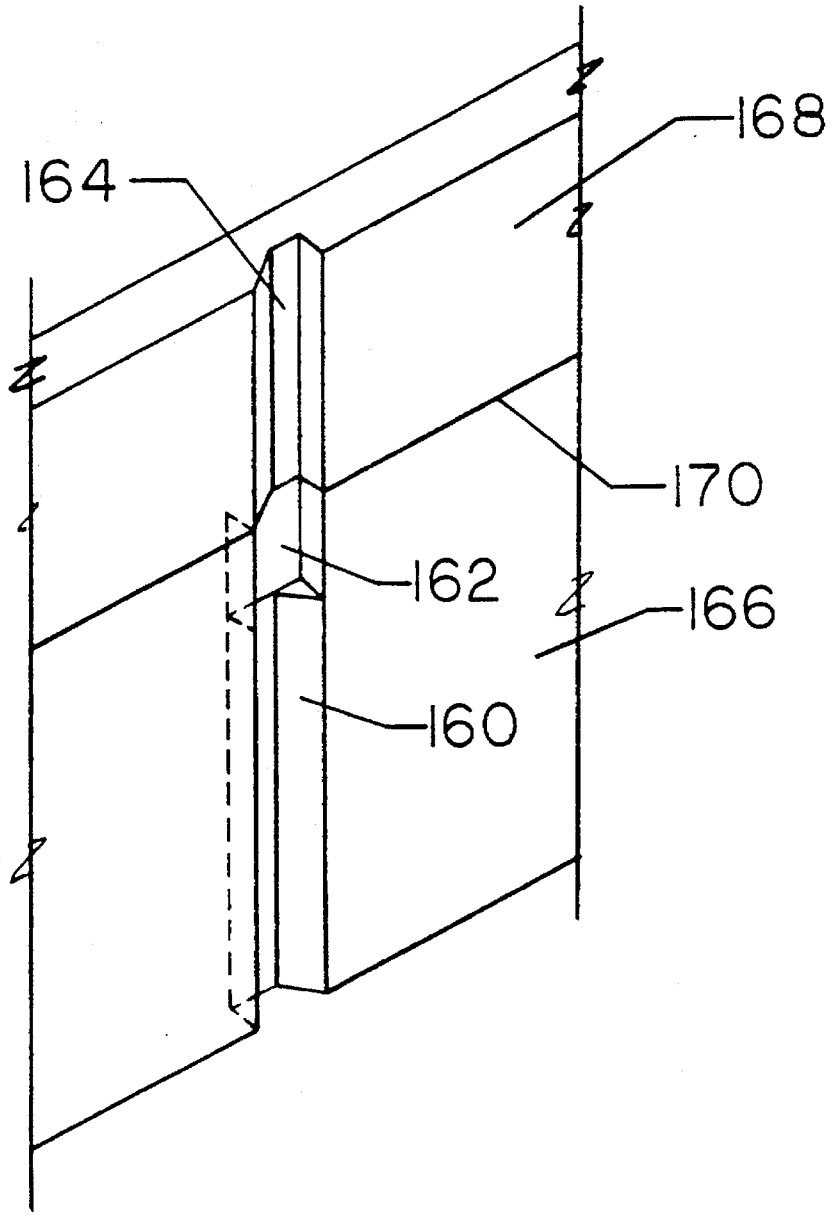
FIG. 9 is a perspective view of keyways formed in the wall of a circuit breaker enclosure to permit proper installation of the arc stack of FIG. 5 into the enclosure.

The arc plates in FIGS. 6–8 of the arc stack 10' are designed to prevent improper installation of the arc stack 10' into a circuit breaker enclosure. In particular, the arc plates 120, 122, and 124 are provided with respective keys 154, 156, and 158 which mate with corresponding keyways in the enclosure. Such keyways are illustrated in FIG. 9 and are designated by the reference numerals 160, 162, and 164. The keyways are formed in adjacent walls 166, 168 of both the base and cover of the enclosure, and the junction between these walls is represented in FIG. 9 by the reference number 170. Furthermore, although only one set of keyways is depicted in FIG. 9, it should be understood that another identical set of keyways is preferably formed in another adjacent pair of base and cover walls spaced from the illustrated walls 166, 168 by the width of the arc stack 10'. An enclosure depicting this second identical set of keyways is disclosed in U.S. patent application Ser. No. 08/195,959 (CRC-35/SQUC132), entitled "Blade Suspension Assembly for a Circuit Breaker", filed concurrently herewith, assigned to the instant assignee, and incorporated herein by reference.

The keyways are positioned in the enclosure walls 160, 162, and 164 so that the arc stack 10' only fits properly into the enclosure when the arc stack sections 110, 112, and 114 are positioned as shown in FIG. 5. More specifically, the keys 154 of the arc plates 120 fit in either the keyway 160 or the keyway 162, and the keys 156, 158 of the respective arc plates 122, 124 fit in either the keyway 162 or the keyway 164. Due to the arrangement of the arc plates 120, 122, and 124 in the arc stack sections 110, 112, and 114, these sections must be arranged as illustrated in FIG. 5 in order for the arc stack 10' to fit properly into the combined keyway formed by the three keyways 160, 162, and 165.

The design of the arc stack 10' promotes the efficient dissipation of an electrical arc, thereby resulting in reduced pressures, higher exit voltages, lower let-through currents, and improved circuit breaker interruption. More specifically, the arc plates 120, 122, 124, and 126 are thinner than the arc plates in FIG. 1, and the air gaps between the arc plates are smaller than the air gaps between the arc plates in FIG. 1. This, in turn, increases the number of arc plates in the arc stack 10', which increases the steel mass of the arc stack 10'. The varying depths and shapes of the arc throats 130, 132, 134, and 136 in the respective arc plates 120, 122, 124, and 126 increases the ability of the arc stack 10' to dissipate an electrical arc.

While the present invention has been described with reference to one or more particular embodiments, those skilled in the art will recognize that many changes may be made thereto without departing from the spirit and scope of the present invention. For example, the arc stack 10' may be modified to include arc plates having more than three types of arc throats. The arc plates are positioned in the arc stack 10' such that the arc throats of the arc plates in the arc stack 10' progressively decrease in size along the length of the arc stack 10'. Each of these embodiments and obvious variations thereof is contemplated as falling within the spirit and scope of the claimed invention, which is set forth in the following claims.

What is claimed is:

1. An arc stack for receiving a circuit breaker blade moveable between a closed position, comprising:

a plurality of arc plates positioned substantially parallel to one another and arranged in a plurality of adjacent groups, each of said groups including one or more arc plates having substantially similar respective arc throats formed therein, said respective arc throats progressively decreasing in size from group to group along the length of the arc stack in a direction extending away from the closed position of the blade; and a connecting support for maintaining said plurality of arc plates substantially parallel to one another, wherein said connecting support includes a first plurality of side fibers and a second plurality of side fibers connected to opposing edges of each of said plurality of arc plates and interconnecting said plurality of are plates to each other, and wherein said first plurality of side fibers include mating portions for interconnecting adjacent ones of said first plurality of side fibers, and wherein said second plurality of side fibers include mating portions for interconnecting adjacent ones of said second plurality of side fibers.

2. The arc stack of claim 1, wherein said plurality of arc plates are arranged in at least first, second, and third groups, said arc throats of said one or more are plates in said first group being larger than said arc throats of said one or more arc plates in said second group, said arc throats of said one or more arc plates in said second group being larger than said arc throats of said one or more arc plates in said third group.

3. The arc stack of claim 2, wherein said arc throats of said one or more arc plates in said second group are narrower over a portion thereof than said arc throats of said one or more arc plates in said first group, and wherein said arc throats of said one or more arc plates in said third group are narrower over a portion thereof than said are throats of said one or more arc plates in said second group.

4. The arc stack of claim 3, wherein said arc throats of said one or more arc plates in said first group have approximately the same width at different depths.

5. The arc stack of claim 4, wherein said arc throats of said one or more arc plates in said second group have a wide portion and a narrow portion, said wide portion having substantially the same width as the width of said arc throats of said one or more arc plates in said first group, said narrow portion being located deeper in said arc throats than said wide portion.

6. The arc stack of claim 5, wherein said arc throats of said one or more arc plates in said third group have approximately the same width at different depths and having approximately the same width as said narrow portion of said arc throats of said one or more arc plates in said second group.

7. The arc stack of claim 6, wherein said third group includes only one arc plate.

8. The arc stack of claim 1, wherein said mating portions of said first and second plurality of side fibers include male and female nubs disposed along interconnecting edges of said first and second plurality of side fibers.

9. A keying arrangement for facilitating installation of a multi-section arc stack into a circuit breaker enclosure, comprising:

the arc stack having at least first and second stackable sections, each of said first and second sections including a plurality of arc plates positioned substantially parallel to one another and a connecting support for maintaining said plurality of arc plates substantially parallel to one another, said plurality of arc plates in said first section having respective keys formed along associated edges thereof such that said first section has a first key configuration extending along the length thereof, said plurality of plates in said second section having respective keys formed along associated edges thereof such that said second section has a second key configuration extending along the length thereof; and the enclosure for receiving said arc stack, said enclosure including a wall forming a keyway configuration, said keyway configuration constructed and arranged to receive said first and second key configurations in response to said first and second sections being stacked in one order and to reject said first and second key configurations in response to said first and second sections being stacked in another order.

10. A multi-section arc stack, comprising:

a lower section including a first plurality of are plates and a first pair of side fibers connected to opposing edges of each of said first plurality of are plates, said first pair of side fibers maintaining said first plurality of are plates substantially parallel to one another, each of said first pair of side fibers including opposing upper and lower edges and opposing side edges, said opposing upper and lower edges of each of said first pair of side fibers being generally parallel to said first plurality of arc plates, said upper edges of said first pair of side fibers forming respective first mating portions; and an upper section including a second plurality of arc plates and a second pair of side fibers connected to opposing edges of each of said second plurality of arc plates, said second pair of side fibers maintaining said second plurality of arc plates substantially parallel to one another, each of said second pair of side fibers including opposing upper and lower edges and opposing side edges, said opposing upper and lower edges of each of said second pair of side fibers being generally parallel to said second plurality of arc plates, said lower edges of said second pair of side fibers forming respective second mating portions, said upper section being stacked on said lower section with said second mating portions coupling with respective ones of said first mating portions to form the arc stack.

* * * * *